US005261265A

United States Patent [19]

Nichols

[11] Patent Number: 5,261,265

[45] Date of Patent: Nov. 16, 1993

[54] COMPLIANCE APPARATUS AND METHODS FOR GRIPPING AND TRANSPORTING WORKPIECE SHEETS SUCH AS APPLIANCE DOOR BLANKS TO BE FORMED TO AND FROM A PROPERLY ALIGNED FORMING POSITION AT A WORK STATION

[75] Inventor: John F. Nichols, Essexville, Mich.

[73] Assignee: RWC, Inc., Bay City, Mich.

[21] Appl. No.: 902,069

[22] Filed: Jun. 22, 1992

[51] Int. Cl.[5] ..... B21D 5/04; B21D 43/18

[52] U.S. Cl. ..... 72/420; 72/422; 72/461; 414/752; 294/64.1; 294/65

[58] Field of Search ..... 72/420, 422, 461; 294/64.1, 65; 414/752, 757

[56] References Cited

U.S. PATENT DOCUMENTS

| | | | |
|---|---|---|---|
| 2,283,613 | 5/1942 | Schmidt . | |
| 3,183,032 | 5/1965 | Warfel . | |
| 3,598,263 | 8/1971 | Ehmke . | |
| 3,955,843 | 5/1976 | Ottenhues et al. . | |
| 4,129,328 | 12/1978 | Littell . | |
| 4,706,491 | 11/1987 | Sartorio | 72/461 |
| 4,827,757 | 5/1989 | Sartorio | 72/420 |
| 4,989,444 | 2/1991 | Murakami et al. | 72/422 |
| 5,042,287 | 8/1991 | Sartorio | 72/422 |
| 5,176,022 | 1/1993 | Sartorio | 72/420 |

FOREIGN PATENT DOCUMENTS

| | | | |
|---|---|---|---|
| 1-258827 | 10/1989 | Japan | 72/420 |
| 1-284438 | 11/1989 | Japan | 72/461 |

*Primary Examiner*—Lowell A. Larson
*Assistant Examiner*—Donald M. Gurley
*Attorney, Agent, or Firm*—Learman & McCulloch

[57] ABSTRACT

Compliance apparatus, for gripping and transporting workpiece sheets such as appliance door blanks to be formed to and from a work station having precision locator sheet stop surfaces, is mounted on a carrier for travel in a generally horizontal path toward the work station. The compliance apparatus includes a plurality of generally horizontally spaced apart, workpiece-aligned suction grippers for collectively gripping the top surface of a workpiece sheet. Resilient mechanism connecting each of the grippers to the carrier provides for relative individual lateral movement of the sheet carrying grippers from neutral positions to positions displaced therefrom in any required direction, as dictated by the sheet engaging one of the locator sheet stop surfaces and being forced to a correctly aligned position in engagement with the other locator sheet stop surface as the carrier moves in its said path of travel. The resilient mechanism restores each gripper to original neutral position when the workpiece leaves the work station and normally maintains it in neutral position.

17 Claims, 6 Drawing Sheets

COMPLIANCE APPARATUS AND METHODS FOR GRIPPING AND TRANSPORTING WORKPIECE SHEETS SUCH AS APPLIANCE DOOR BLANKS TO BE FORMED TO AND FROM A PROPERLY ALIGNED FORMING POSITION AT A WORK STATION

BACKGROUND OF THE INVENTION

This invention relates to sheet transfer apparatus having a plurality of generally horizontally spaced grippers for gripping the top surface of the sheet and transporting it to a work station where it is maneuvered into a correctly aligned position for a sheet forming operation such as edge folding. Prior art machinery for accomplishing these objectives has been of a complex, massive, and expensive design which has not been as maneuverable.

Because of their size and thickness, blanks of the type used for forming refrigerator doors, for example, are somewhat flexible and must be handled with considerable care. It is necessary that the suction cups which grip the sheet maintain a sealed engagement with the top surface of the sheet throughout the transfer operation in order to prevent them from dropping and being damaged. For this reason, it is impractical to move the suction cups relative to the sheet once they have been engaged with the sheet and a vacuum has been applied to the cups. It is, further, necessary in automation operations, wherein the workpieces are moved from one station to another along a manufacturing line, that the refrigeration doors or the like, be manufactured with great precision, and the emphasis today is on greater and greater speeds of production. A further emphasis today in such machinery, is the versatility to handle different sizes so that the production lines can be quickly changed over to produce doors of different size, with a minimum of changeover time involved. Prior art machines have not been sufficiently versatile in this respect to the extent necessary to be as useful in today's high production rate automated production lines. The prior art machinery known to applicant employed a transfer carriage with a large plate having a plurality of suction cup grippers fixed thereto such that the grippers were not shiftable on the plate relative to one another or the plate. The relatively massive plate was itself shiftable on the carriage when compliance was required, and this shifting was opposed by large return springs. This prior art machinery was a high friction, inertia oriented system which was nowhere near as maneuverable or compliant as the compliance apparatus of the present invention where individual grippers can shift relative to and responsive to the shifting of other grippers.

SUMMARY OF THE INVENTION

It is, therefore, an object of the present invention to provide a suction cup or gripper transfer and aligning apparatus for moving the sheets or blanks to and from the work station, and for aligning them with the required precision and sensitivity at the work station at the speeds at which the machines must operate.

Another object of the invention is to provide a highly versatile mechanism of the character described which accommodates to the production of appliance doors, or the like, of different size.

Another object of the invention is to provide a sheet handling device of the type mentioned wherein the sheet being transferred can be moved relative to the transfer apparatus to an aligned position for forming, and then gripped by work station holding devices, without disengaging the suction cup grippers.

Still another object of the invention is to provide an assembly of the character described wherein, upon release of the workpiece gripping members at the work station, the sheet during movement from the station, is reoriented to its exact original alignment vis-a-vis the transfer carriage with return of each of the individual grippers to original position.

Other objects and advantages of the invention will become apparent with reference to the accompanying drawings and the accompanying descriptive matter.

IN THE DRAWINGS

DESCRIPTION OF THE PREFERRED EMBODIMENT

Figure 1:
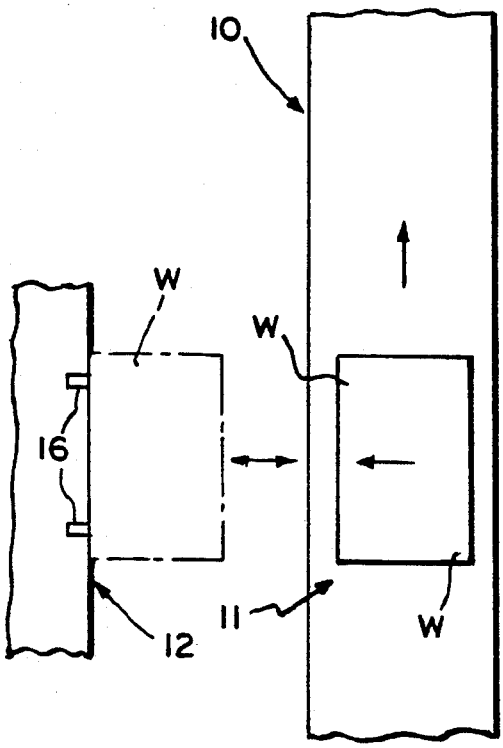
FIG. 1 is a schematic top plan view, illustrating the path of travel of the workpiece sheet to and from a forming position.

Referring now more particularly to the accompanying drawings, and in the first instance to FIG. 1, wherein only what might be termed a typical operation is schematically illustrated, a numeral 10 generally indicates a longitudinally extending shuttle conveyor line wherein a series of sheet workpieces W are conveyed in a production line to a workpiece pickup and discharge station generally designated 11. It is, of course, not necessary that the workpiece be picked up and discharged at the same station, but, when this is done, the workpiece transfer mechanism for moving the workpiece W from the conveyor 10 over to a workpiece forming station generally designated 12 can move in a reciprocating path.

Figure 2:
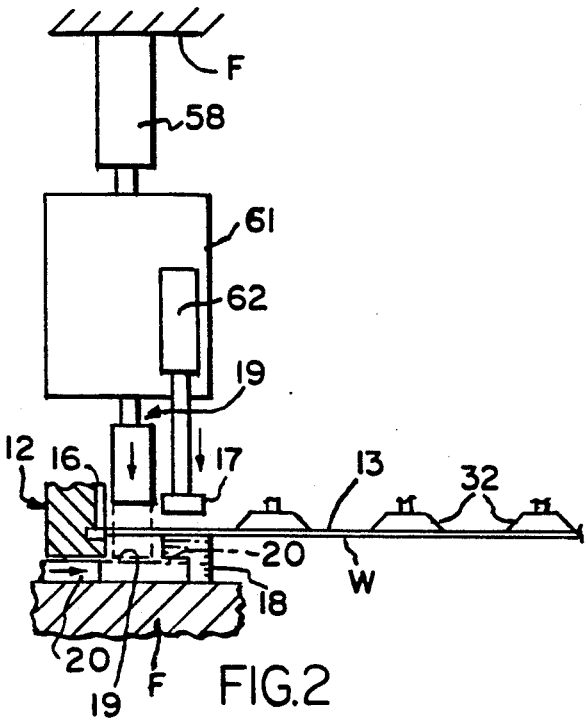
FIG. 2 is a schematic sectional elevational view schematically depicting the forming elements at the work processing station, the chain lines indicating the advanced positions of the forming tools.
Figure 10:
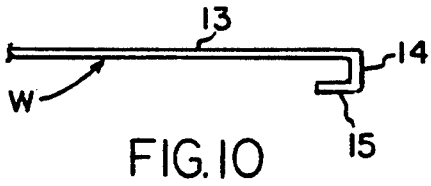
FIG. 10 is a fragmentary elevational view of the door edge, illustrating the edge forming operation which is performed at the work station.

In FIG. 2, I have shown the workpiece forming station as comprising a station for edge folding the sheet workpiece in the manner illustrated in FIG. 10. It is to be understood that the transfer carriage, to be later described, for moving the workpiece W from the pickup station at 11 over to the work station 12, utilizes suction cups to engage the top surface 13 of the worksheet W and grip it in a manner to support its weight so that it can be transferred over to the station 12. Typically, as shown in FIG. 10, the workpiece W is to have its edge folded down as at 14, and then the edge 14 formed with an inturned flange 15. As shown in FIG. 2, once the workpiece reaches, and is correctly aligned with, the electrically conductive locator stop surfaces 16 provided at the work station 12, an upper workpiece clamping member 17 travels downwardly toward a frame bed mounted, L-shaped, fixed clamping member 18 to engage the workpiece W and positively grip it. Member 17 may be operated by a suitable hydraulic cylinder system to be later described, or in any other acceptable manner. It is to be understood that the locator blocks 16 and clamp members 17 and 18 are illustrated only schematically.

The element 19 interposed between the members 16 and the grippers 17 and 18 is a vertically reciprocable forming tool 19 which bends the edge of the workpiece vertically to the position in which it is shown at 14. Then, while the tool 19 remains in position, the horizontal forming tool 20 is moved inwardly to form the flange 15. The forming of the edge which has been described is accomplished while the suction members 13 remain in sealed engagement with the top surface of the workpiece W. The forming tools 19 and 20 can be similarly reciprocated by suitable hydraulic cylinders, or in any other acceptable manner which will accomplish the edge folding and flanging operations in sequence. It is anticipated that other forming operations may be performed and the edge and flange folding operation which has been described is only intended to be illustrative of a forming operation which can be performed on the workpiece W.

Figure 4:
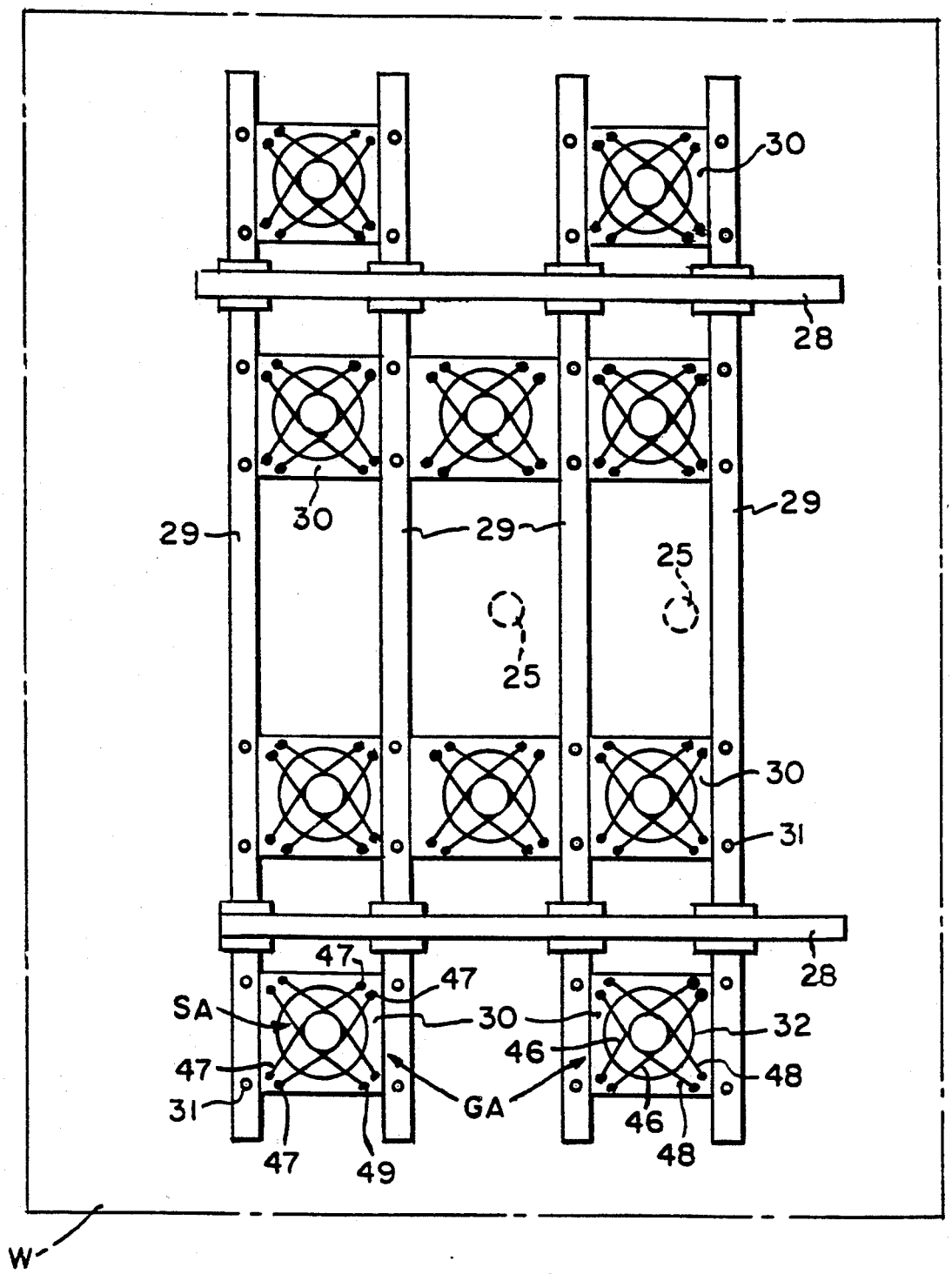
FIG. 4 is a somewhat schematic, fragmentary, top plan view, illustrating one disposition of the various suction grippers on the transfer carriage for gripping the sheet being transferred.

The present invention is concerned with the apparatus for moving the sheet to and from the workpiece and aligning it in the manner which will be described. FIG. 4 illustrates a typical disposition of the suction cups with respect to the workpiece they are gripping, and it should be understood that the arrangement depicted is only typical in nature and may be varied to suit the particular workpiece involved. In the present case the disposition is such that the suction cups can grip and transfer several different sizes of workpiece sheets in a manner which will be presently described.

Figure 5:
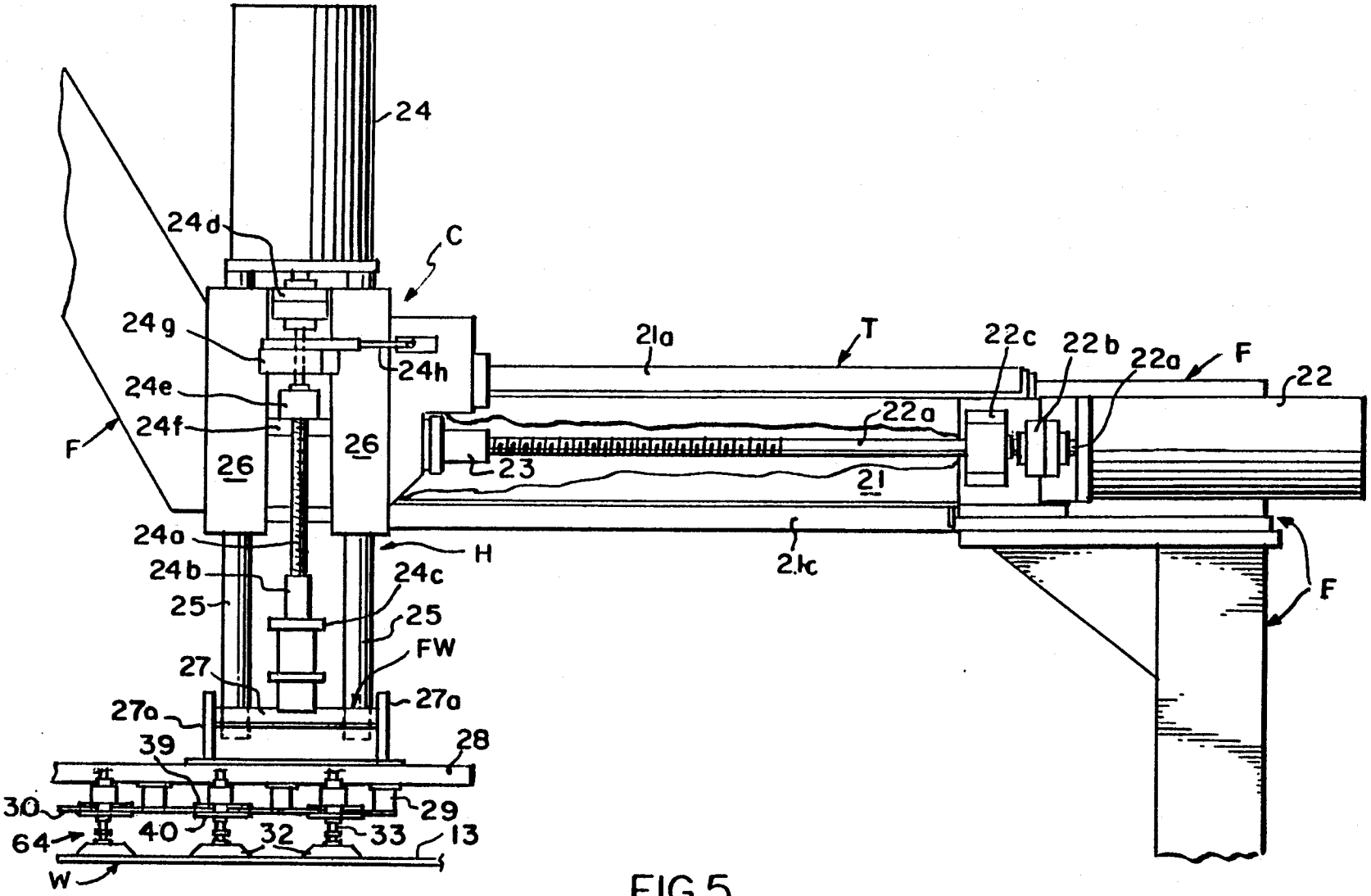
FIG. 5 is a fragmentary side elevational view of the transfer carriage.
Figure 6:
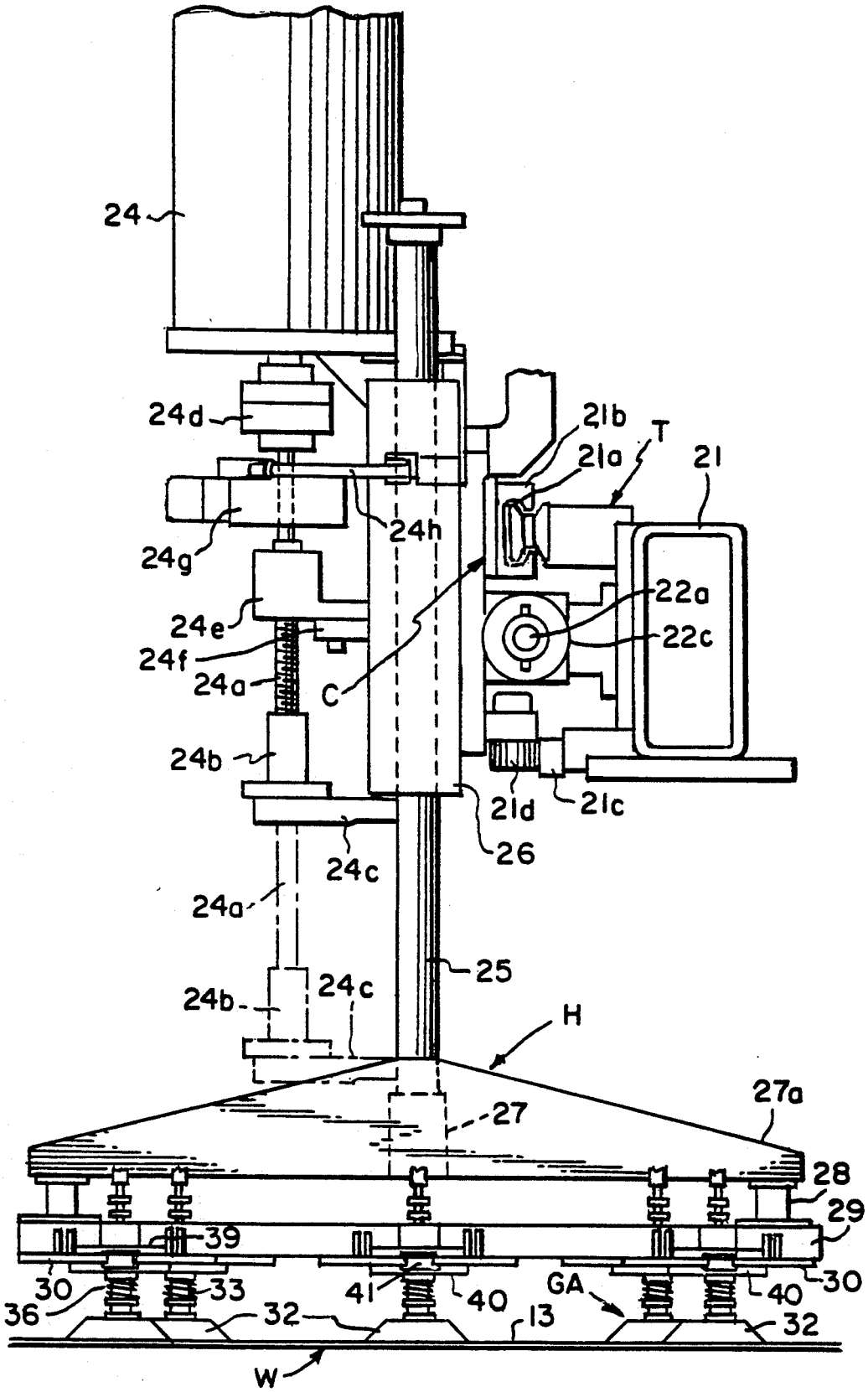
FIG. 6 is a fragmentary sectional end elevational view of the transfer carriage, illustrating another disposition of the grippers.

As shown in FIGS. 5 and 6 the workpiece transfer carriage, which I have generally designated C, is mounted for horizontal travel and carries a head mounted for vertical travel. As these figures indicate, the carriage is supported for lateral travel by the horizontal beam 21 of a frame F. A beam trackway, generally designated T, is formed by an upper part 21*a*, received within a track 21*b* secured to the carriage C, and a lower guide rail 21*c* which is engaged by a roller 21*d* rotatably mounted on the carriage C. A reversible stepping electric motor 22, supported on frame F, revolves a screw 22*a*, which is received by a ball nut 23 fixed to carriage C, to move the carriage back and forth horizontally Screw 22*a* is coupled to the shaft of motor 22 by a coupling 22*b* and journaled for rotation by a bearing 22*c* fixed to the beam 21.

A similar reversible stepping electric motor 24 mounted on carriage C, revolves a screw 24*a* which is received by a ball nut 24*b* connected by bracket 24*c* to the vertically moving head H, which has vertically extending guide rods 25 received by carriage bearing structure 26. The screw 24*a* is coupled to the motor 24 by a coupling 24*d* and supported by a bearing 24*e* connected to bearing housings 26 by plate 24*f*. A brake 24*g* which is fixed to the carriage C, as via coupling 24*h*, can be electrically energized to grip the screw shaft 24*a* and hold it in any vertical position.

The head H has a framework FW which includes cross plate 27 spanning end members 27*a*, which support rails 28. Rails 29 connected to rails 28 provide mounts for the gripper assemblies, generally designated GA, which include gripper support plates 30 (FIGS. 7 and 8) which fix to the members 29, as with bolts 31.

Figure 9:
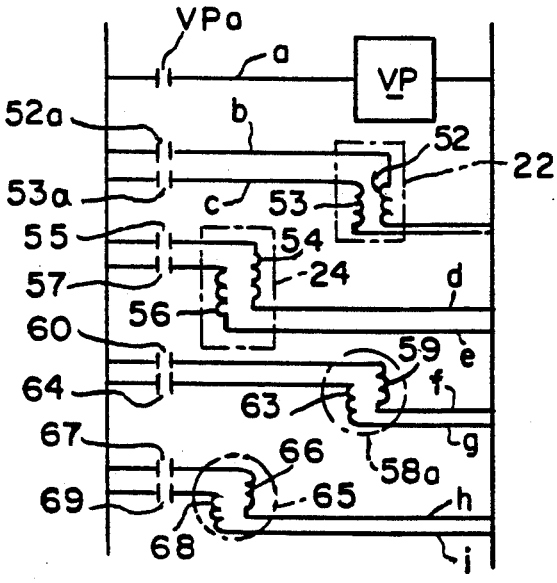
FIG. 9 is a schematic electrical control diagram.
Figure 8:
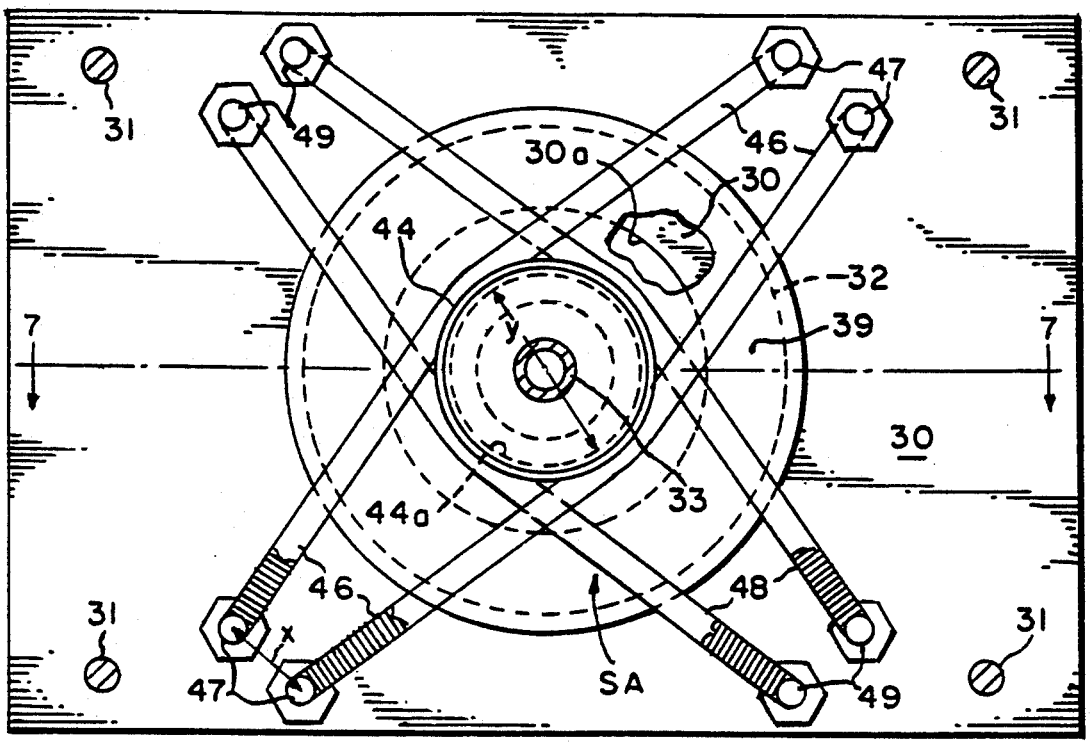
FIG. 8 is a top plan sectional view, taken on the line 8—8 of FIG. 7 thereof.
Figure 7:
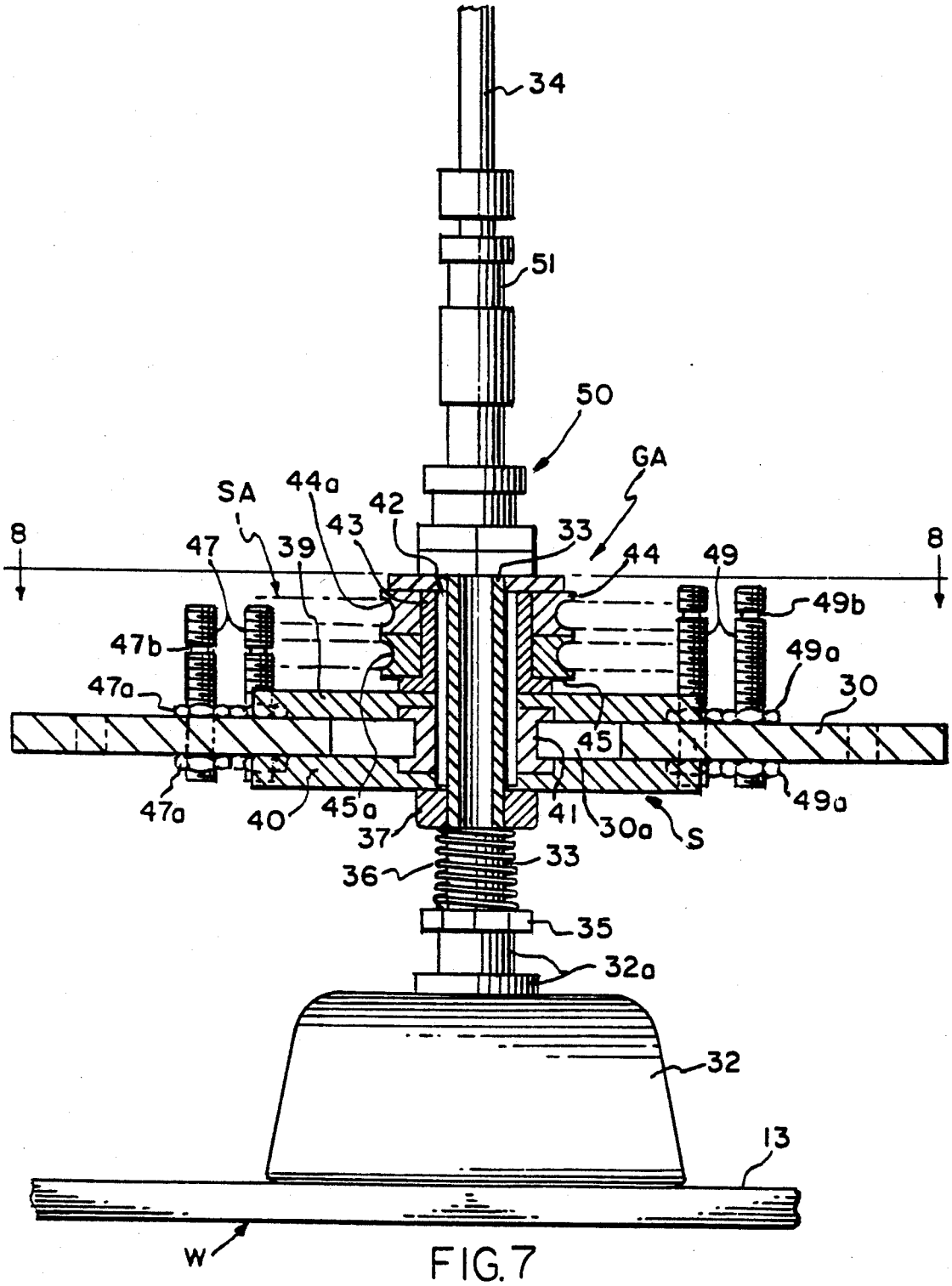
FIG. 7 is a sectional side elevational enlarged view of one of the gripper member assemblies only taken on the line 7—7 of FIG. 8, the chain lines indicating the coil springs which are used.

As FIG. 4 and 7 particularly indicate, each of the suction gripper assemblies GA is an independently mounted unit but the suction cups or grippers 32 are provided in horizontal alignment such that all simultaneously sealingly engage the workpiece blank or sheet W to be transported. Each of the assemblies GA further includes a tubular stem 33 on which the cup 32 is slidably mounted. The upper end of the stem 33 connects to a flexible tube 34 which leads to a suitable source of vacuum, such as a vacuum pump VP (FIG. 9). The vacuum cup assembly GA depicted in FIGS. 7 and 8 is typical of all of the vacuum cup assemblies GA, so that a description of one will suffice for all.

It will be seen that each vacuum cup 32, which may be constructed of a suitable resilient rubber or the like, has a sleeve hub 32*a* which is slideably received on the stem 33 so that it is capable of upward travel thereon. A tubular bolt-like member 35, is threaded into hub 32*a* and provides a seat for a coil spring 36 which also bears against a nut 37 fixed on stem 33, and normally urges the cup 32 to lowermost position on stem 33.

Nut or collar 37 supports a lateral slide assembly, generally designated S, comprising a pair of vertically spaced apart disc members 39 and 40 which are fixedly connected by a hub 41 keyed to spindle stem 33 as at 42.

As previously indicated, the stem 33 extends up through a considerably enlarged opening 30*a* provided in the pad or plate 30, and the spindle 33 is shiftable or slideable laterally in any one of the 360° directions to a certain extent, the plates 39 and 40 sliding laterally on the pad 30 to the extent required to provide for the relative lateral individual adjustment of each suction cup 32 relative to the others in a manner to be presently described. Also keyed to the normally centrally extending tubular stem 33 is a flange bearing 43 on which a pair of separate, or integrated, rotatable superposed pulley-like spool guides 44 and 45 are fixed. Each of the guides 44 and 45 is provided with an annular peripheral groove, denominated 44*a* and 45*a* respectively.

To maintain the assembly GA normally in the central position in pad opening 30*a*, a resilient spring assembly, generally designated SA, incorporates an upper pair of coils springs 46, extending from anchor posts 47 (FIGS. 7 and 8) provided on the plate 30 to engage in the grooves 44*a* on opposite sides of the guide spool 44. The spring assembly SA further incorporates a similar pair of 90° oppositely extending springs 48, anchored to anchor posts 49 to extend around the guide spools 45 and engage in opposite sides of the groove 45*a*. The threaded posts 47 and 49 may be secured by lock nuts 47*a* and 49*a* and it will be noted they include annular grooves 47*b* and 49*b* around which the free ends of springs 46 and 48 are wrapped to secure them in position. It will be noted that the spacing "x" (FIG. 8) between the anchor posts 47 and 49 is less than the inner diameter "y" of the grooves 44*a* and 45*a* so that the springs 46 and 48 are displaced outwardly and placed in tension, when in installed position. The stretched sets of springs 46 and 48 normally, then, maintain the stem 33 in a central position extending up through opening 30*a*. Lock nut assembly 50 maintains the assembly in position on stem 33 and member 51 is a coupling for uniting the flexible tube 34 and rigid stem 33 in sealed relation.

In FIG. 9, I have shown a schematic electrical control diagram wherein the vacuum pump VP is connected in a circuit line "a", which also has valve contacts VPa for communicating the vacuum pump with all of the tubes 34 simultaneously, or alternately communicating the lines 34 with atmospheric pressure to relieve the suction forces imposed on the cups. The reversible actuator motor 22 is shown as having a winding 52 in circuit line "b" in circuit with contacts 52*a*, which, when closed energize the winding 52 to advance the carriage C and head H toward the work station 12. A reversing winding 53 is provided in a circuit line "c" in circuit with contacts 53*a* which, when closed, energize the motor winding 53 to restore the head H to original position.

Provided in a circuit line "d" is the motor winding 54 for actuator motor 24 which is in circuit with contacts 55 which, when closed, energize the winding 54 to operate the actuator motor 24 to move head H downwardly. A motor reversing winding 56 is shown in a circuit line "e" in circuit with contacts 57 which, when closed, energize the reversing winding 56 to cause actuator motor 24 to move the head H upwardly.

Also schematically shown, is a hydraulic cylinder 58 (FIG. 2) having a control valve 58*a* with a cylinder advance solenoid 59 provided in a circuit line "f" in circuit with contacts 60 to power clamp 17 and edge folding tool 19 to move downwardly when the two contact plates 16 are electrically in circuit through workpiece W.

The locator plates 16 provide an excellent low voltage continuity sensing system to indicate the workpiece W is in precisely located position. It will be noted that cylinder 58 connects between frame F and a vertically movable ram 61 which mounts a cylinder 62 connected to gripper clamp 17. Because clamp 17 vertically leads the tool 19 the workpiece is positively gripped before tool 19 commences the edge folding operation. A retract valve solenoid 63 in circuit with contacts 64 in circuit line "g" restores ram 61. The cylinder 62 piggybacked on the ram 61 may be a pressure relieved hydraulic cylinder which maintains a constant gripping pressure via clamp 17. Alternately, a suitable conventional spring system may be used.

Finally, a hydraulic cylinder (not shown) for moving the tool 20 to form flange 15 has its control valve 65 advance solenoid 66 in circuit with contacts 67 in circuit line "h". The retract solenoid 68 of control valve 65 is in circuit with contacts 69 in a circuit line "i" for restoring the tool 20 to the position shown in FIG. 2.

It is to be understood that a conventional programmable controller is employed to close the various contacts depicted in FIG. 9 in proper sequence then, when required prior steps, such as a workpiece sheet electrically connecting the locator surfaces 16, have been performed. The FIG. 9 diagram is intended as only a schematic representation of elements which are energized to perform the various operations.

THE OPERATION

Referring particularly to FIG. 1, in the first instance, it will be assumed that the workpiece W is in position on shuttle conveyor 10 before pickup and that the transfer carriage C (FIGS. 5 and 6) is in fully retracted position with its gripper assemblies GA located directly over and above the workpiece sheet W. Motor 24 is energized to revolve screw 24*a* and lower the suction cups 32 on head H into engagement with the workpiece sheet, whereupon vacuum pump VP is communicated with the cups 32, which grip the sheet. Because the workpiece sheet is relatively large in area and may be only 0.026–0.036 thousandths of an inch in thickness, it will tend to be flexible with portions out of plane and some of the springs 36 may be compressed when the head H is lowered. The gripping operation, however, tends to planarly straighten at least the portion of the sheet which is gripped. Through appropriate reversing of motor 24, the head H may then be raised to a position for transporting the sheet.

Thereafter, traversing motor 22 is energized to move the carriage C, and the head H thereon, in a lateral direction toward the work station 12 and contacts 16. The edge of the sheet is moved between the gripper surfaces 17 and 18 and, if the leading edge of the sheet sags significantly, it may be advisable to bring it in high and then lower it to a position of engagement with the stationary gripper 18.

Figure 3:
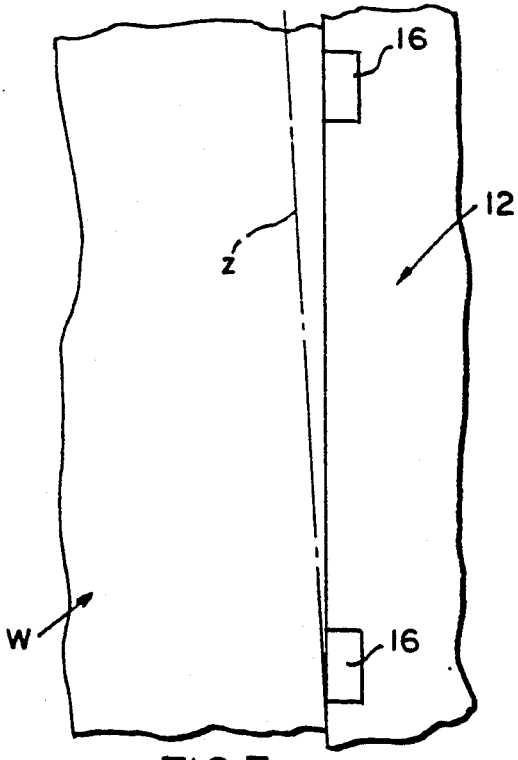
FIG. 3 is a schematic top plan view illustrating, and somewhat exaggerating, the manner in which the workpiece edge changes position, from the position indicated by the chain line to the position indicated by the solid line, to assume a proper orientation at the work station.

In FIG. 3 the chain line "z" represents the leading edge of a workpiece sheet W which is skewed with respect to the continuity locator plates 16. As FIG. 3 indicates, the workpiece edge "z" has first engaged one of the contact plates 16 and remains still spaced from the other one. To reach the solid line position shown in FIG. 3, in which the edge is in contact with both plates 16, it will be necessary for the workpiece sheet to pivot about the one locator plate 16 into engagement with the other. This pivoting will create a need for the gripper assemblies GA to move individually with relation to one another in differing increments of travel. This can be accomplished with the present compliance structure with movement of the stems 33 from the centrally neutral position via lateral shifting of the guide plates 39 and 40 while suction cups 32 remain in sealed engagement with the upper surface of the workpiece sheet W. This movement will be opposed by those springs 46 and 48 which are affected by the movement in the required direction.

When metal contact plates 16 are electrically joined by the metal workpiece sheet W, the circuit is made to cause control valve 58*a* for cylinder 58 to power the ram 61 downwardly and engage the gripper 17 with the upper surface of the workpiece sheet W to cause it to be gripped between the members 17 and 18. At this time tool 19, which vertically lags the gripper 17, will be just out of engagement with the upper surface of workpiece sheet W, and cylinder 62 will be slightly compressed by the movement of ram 61 to grip the workpiece W against fixed clamp 18. Further movement of cylinder 58 to force ram 61 downwardly advances the tool 20 to form the flange 15, while further compressing cylinder 62. Tool 20, then, withdraws when the retract solenoid 68 of valve 65 is energized, and ram 61 withdraws to fully raised position when the retract solenoid 63 of valve 58*a* is energized.

The advance winding 52 of motor 22 is then energized to move the workpiece further toward station 12 until return flange 15 is vertically clear of the fixed clamp 18. At this point, motor 24 can be operated to raise the workpiece sheet W to clear the upper surface of clamp 18, and then motor 22 can be operated to move the carriage C back to the conveyor 10. As soon as it is released by clamp 17, the workpiece sheet W is reoriented to original position by the springs 46 and 48 which restore the stems 33 to neutral positions. With the vacuum pump VP being deenergized after the motor 24 then brings the workpiece sheet down to the shuttle conveyor 10, the workpiece W may be deposited in its original position of orientation relative to shuttle conveyor 10. While only one edge folding operation has been described, it is to be understood that additional edges of the workpiece will also be folded and a compliance assembly of the same design will be useful in effecting this additional edge folding.

It is to be understood that the embodiments described are exemplary of various forms of the invention only and that the invention is defined in the appended claims which contemplate various modifications within the spirit and scope of the invention.

I claim:

1. Compliance apparatus for gripping and transporting workpiece sheets such as appliance door blanks to be formed to and from a work station having locator sheet stop surfaces, comprising:

a. a frame mounted adjacent the work station;

b. a carrier mounted on said frame for travel in a generally horizontal path from a more remote position toward the work station;

c. a plurality of generally horizontally spaced apart, workpiece-aligned gripper devices depending from said carrier for collectively gripping the top surface of a workpiece sheet;

d. mechanism connecting each of said gripper devices to said carriage to provide for relative individual lateral movement of said gripper devices from a neutral position on said carriage to positions displaced therefrom in any direction, as dictated by the sheet engaging one of said locator sheet stop surfaces and being prevented from traveling further with the carriage in its said path of travel relative to said one stop surface; said mechanism including resilient members connecting each gripper device to the carriage for restoring each gripper device to neutral position and normally maintaining it in neutral position.

2. The apparatus of claim 1 wherein said gripper devices comprise vertically extending tubular stems, connected to a vacuum source and mounting suction cups on their lower ends.

3. The apparatus of claim 2 wherein said carrier includes a plurality of generally horizontal support plates having a plurality of spaced apart openings therein up through which said stems extend for connection at their upper ends to said vacuum source, said stems being of considerably reduced cross-sectional size relative to said openings so as to be laterally shiftable therein; and said resilient members normally maintaining each of said stems in a central neutral position with respect to the opening through which it extends.

4. The apparatus of claim 3 wherein mount devices, permitting lateral shifting of said stems in said openings, secure said stems to said plate to prevent relative vertical movement of the stems and plate.

5. The apparatus of claim 4 wherein said suction cups are mounted for limited vertical movement on said stems upwardly from their lowermost positions.

6. The apparatus of claim 5 wherein springs on said stems normally bias said suction cups to said lowermost positions.

7. The apparatus of claim 3 wherein said resilient members comprise springs anchored to said plates and embracing said stems.

8. The apparatus of claim 3 wherein superposed pulley-like guides are mounted on each stem above each plate, each guide having a peripheral groove, and said resilient members comprise pairs of coil springs with their ends anchored to each plate on opposite sides of each stem, the springs being accommodated in the grooves and positioned to be bowed outwardly and stretched to be placed in tension by said guides.

9. The apparatus of claim 8 in which upstanding anchor posts are provided on each plate for affixing of the ends of the springs, and crisscrossed pairs of said springs are affixed in generally parallel relation, each pair of springs being accommodated in the groove of one of the guides, on opposite sides thereof.

10. The apparatus of claim 9 in which said pairs of springs extend generally perpendicularly to one another.

11. The apparatus of claim 3 wherein said resilient members comprise coil springs anchored to each said plate and biased to resist movement of the stems of said grippers.

12. In a method of transporting a workpiece sheet such as an appliance door blank to a forming work station having a forming tool assembly and spaced sheet locator surfaces, and employing a carriage mounted on a frame for lateral travel from a sheet pickup station over to the work station, the carriage having a plurality of generally horizontally spaced suction grippers for collectively engaging and gripping the top surface of said sheet, there being mechanism connecting each of the grippers to the carriage so as to provide for relative lateral relative movement of the grippers from neutral positions on said carriage to positions displaced therefrom, and resilient members connected to normally maintain the grippers in neutral position; the steps of:

a. relatively moving the grippers vertically to engage the workpiece sheet at said pickup station;

b. applying suction to said grippers to grip said sheet;

c. moving said carriage in a path toward said work station and moving the sheet into engagement with one of said locator surfaces;

d. moving said individual grippers relative to one another and said carriage against the bias of said resilient members to displace them from said neutral positions, as dictated by the sheet engaging said one sheet locator surface and continuing to move toward the other sheet locator surface, to positions relative to one another in which the sheet is flush with the locator surfaces and in position for forming; and e. forming said sheet.

13. The method of claim 12 in which said forming comprises down-folding of the edge of the sheet at the work station.

14. The method of claim 13 in which said forming further includes forming an inturned flange on the down-folded edge.

15. The method of claim 12 in which said carriage is moved away from the work station to transfer the grippers and said grippers are returned to said neutral positions by said resilient members to reorient the sheet.

16. The method of claim 15 wherein said suction is disabled to release the sheet at a discharge station.

17. The method of claim 12 in which said sheet locating surfaces are electrically connected in a circuit energized through the workpiece sheet when the workpiece sheet is in contact with both locator surfaces and forming is thereby initiated.

* * * * *